US010822952B2

(12) United States Patent
Beattie et al.

(10) Patent No.: US 10,822,952 B2
(45) Date of Patent: Nov. 3, 2020

(54) FEATURE TO PROVIDE COOLING FLOW TO DISK

(71) Applicant: UNITED TECHNOLOGIES CORPORATION, Hartford, CT (US)

(72) Inventors: Jeffrey S. Beattie, South Glastonbury, CT (US); Jason D. Himes, Tolland, CT (US); Matthew Andrew Hough, West Hartford, CT (US); Christopher Corcoran, Manchester, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 661 days.

(21) Appl. No.: 15/021,060

(22) PCT Filed: Sep. 17, 2014

(86) PCT No.: PCT/US2014/056023

§ 371 (c)(1),
(2) Date: Mar. 10, 2016

(87) PCT Pub. No.: WO2015/073112

PCT Pub. Date: May 21, 2015

(65) Prior Publication Data

US 2016/0222787 A1 Aug. 4, 2016

Related U.S. Application Data

(60) Provisional application No. 61/886,159, filed on Oct. 3, 2013.

(51) Int. Cl.
*F01D 5/08* (2006.01)
*F01D 5/30* (2006.01)
(Continued)

(52) U.S. Cl.
CPC ..... *F01D 5/081* (2013.01); *F01D 5/082* (2013.01); *F01D 5/085* (2013.01); *F01D 5/12* (2013.01);
(Continued)

(58) Field of Classification Search
CPC ..... F01D 5/081; F01D 5/082; F01D 5/085; F01D 5/3007; F01D 5/3015; F05D 2240/81
See application file for complete search history.

(56) References Cited

U.S. PATENT DOCUMENTS 3,768,924 A * 10/1973 Corsmeier ..... F01D 5/081 416/95
4,536,129 A 8/1985 Jankot
(Continued)

FOREIGN PATENT DOCUMENTS

EP 2514923 10/2012
WO 2014033408 3/2014

OTHER PUBLICATIONS

International Search Report and Written Opinion for PCT Application No. PCT/US2014/056023, dated Jun. 29, 2015.
(Continued)

*Primary Examiner* — Moshe Wilensky
*Assistant Examiner* — Christopher R Legendre
(74) *Attorney, Agent, or Firm* — Carlson, Gaskey & Olds, P.C.

(57) ABSTRACT

An assembly according to an exemplary aspect of the present disclosure includes, among other things, a disk, a cover plate providing a cavity at a first axial side of the disk, a passageway including an inlet provided by a notch in at least one of the disk and the cover plate in fluid communication with the cavity, and the passageway extending from the inlet to an exit provided at a second axial side of the disk
(Continued)

opposite the first axial side, the exit in fluid communication with the inlet, and the passageway configured to provide fluid flow from the cavity to the exit.

8 Claims, 5 Drawing Sheets

(51) Int. Cl.
*F01D 5/18* (2006.01)
*F01D 5/12* (2006.01)

(52) U.S. Cl.
CPC ..... *F01D 5/187* (2013.01); *F01D 5/3007* (2013.01); *F01D 5/3015* (2013.01); *F05D 2220/32* (2013.01); *F05D 2240/81* (2013.01); *F05D 2260/20* (2013.01)

(56) References Cited

U.S. PATENT DOCUMENTS 5,310,319 A 5/1994 Grant et al.
5,511,945 A 4/1996 Glezer et al.
6,183,193 B1 * 2/2001 Glasspoole ..... F01D 5/08 415/115
6,331,097 B1 * 12/2001 Jendrix ..... F01D 5/081 416/219 R
6,481,959 B1 11/2002 Morris et al.
7,059,835 B2 * 6/2006 Tiemann ..... F01D 11/006 416/193 A
7,114,339 B2 10/2006 Alvanos et al.
7,300,246 B2 11/2007 Durocher et al.
8,038,399 B1 10/2011 Liang
2005/0196278 A1 9/2005 Boswell
2005/0232751 A1 10/2005 Townes et al.
2011/0200448 A1 8/2011 Elliott et al.
2012/0082568 A1 4/2012 Tibbott et al.
2012/0148406 A1 6/2012 Halfman et al.
2015/0322796 A1 * 11/2015 Roussely-Rousseau ..... F01D 5/082 415/180
2016/0222787 A1 * 8/2016 Beattie ..... F01D 5/081
2016/0222788 A1 * 8/2016 Hough ..... F01D 5/081
2016/0273370 A1 * 9/2016 Belshaw ..... F01D 5/081

OTHER PUBLICATIONS

Supplementary Partial European Application No. 14861286.4, dated Aug. 31, 2017.
The International Preliminary Report on Patentability for PCT Application No. PCT/US2014/056023, dated Apr. 14, 2016.

* cited by examiner

FEATURE TO PROVIDE COOLING FLOW TO DISK

CROSS-REFERENCE TO RELATED APPLICATIONS

This application claims priority to U.S. Provisional Application No. 61/886,159, which was filed on Oct. 3, 2013, and is incorporated herein by reference.

STATEMENT REGARDING FEDERALLY SPONSORED RESEARCH OR DEVELOPMENT

This invention was made with government support under Contract No. FA8650-09-D-2923-0021 awarded by the United States Air Force. The Government has certain rights in this invention.

BACKGROUND

This disclosure relates to a disk assembly configured to provide fluid flow to a rotating section of a gas turbine engine.

A gas turbine engine typically includes a fan section, a compressor section, a combustor section and a turbine section. Air entering the compressor section is compressed and delivered into the combustion section where it is mixed with fuel and ignited to generate a high-speed exhaust gas flow. The high-speed exhaust gas flow expands through the turbine section to drive the compressor and the fan section. The compressor section typically includes low and high pressure compressors, and the turbine section includes low and high pressure turbines.

The high pressure turbine drives the high pressure compressor through an outer shaft to form a high spool, and the low pressure turbine drives the low pressure compressor through an inner shaft to form a low spool. The fan section may also be driven by the low inner shaft. A direct drive gas turbine engine includes a fan section driven by the low spool such that the low pressure compressor, low pressure turbine and fan section rotate at a common speed in a common direction.

Difficulties encountered in the design and operation of gas turbine engines result from the extreme temperatures to which the engine components, particularly the turbine blades, are exposed. Accordingly, an assembly for providing fluid flow to a rotating section of a gas turbine engine is disclosed.

SUMMARY

An assembly according to an exemplary aspect of the present disclosure includes, among other things, a disk, a cover plate providing a cavity at a first axial side of the disk, a passageway including an inlet provided by a notch in at least one of the disk and the cover plate in fluid communication with the cavity, and the passageway extending from the inlet to an exit provided at a second axial side of the disk opposite the first axial side, the exit in fluid communication with the inlet, and the passageway configured to provide fluid flow from the cavity to the exit.

In a further non-limiting embodiment of the foregoing assembly, the passageway is included an upper surface of the disk.

In a further non-limiting embodiment of either of the foregoing assemblies, a first blade slot is included in the disk receiving a first blade, and a second blade slot in the disk receiving a second blade, the upper surface extending circumferentially between the first and second blade slot.

In a further non-limiting embodiment of any of the foregoing assemblies, the first blade includes a first blade shelf, the second blade includes a second blade shelf, the first blade shelf and the second blade shelf are radially outward of the upper surface, and the first blade shelf, the second blade shelf and the upper surface provide the passageway.

In a further non-limiting embodiment of any of the foregoing assemblies, the first blade includes a first blade platform, and the first blade shelf is radially inward of the first blade platform.

In a further non-limiting embodiment of any of the foregoing assemblies, a rimseal is adjacent and radially inward of the first and second blade shelf.

In a further non-limiting embodiment of any of the foregoing assemblies, the exit is provided by an opening in the rimseal.

In a further non-limiting embodiment of any of the foregoing assemblies, the exit is provided by an opening in at least one of the first and second blade shelf.

In a further non-limiting embodiment of any of the foregoing assemblies, at least one of the first and second blade shelf is contoured to provide the exit.

In a further non-limiting embodiment of any of the foregoing assemblies, including a fluid source, the fluid source configured to provide fluid to the cavity.

In a further non-limiting embodiment of any of the foregoing assemblies, including a fluid source, the fluid source configured to provide fluid through the cavity, into the inlet and out of the exit, wherein the fluid source also provides fluid through the cavity and to the first blade.

In a further non-limiting embodiment of any of the foregoing assemblies, the cavity is configured to separately provide fluid flow from the cavity to at least one of the first and second blade.

A method according to an exemplary aspect of the disclosure includes, among other things, communicating a fluid from a fluid source to a first cavity, the first cavity provided by a cover plate attached to a first axial side of a disk, and allowing the fluid to flow across an outer surface of the disk and through an exit at a second axial side opposite the first axial side.

In a further non-limiting embodiment of the foregoing method, the fluid source is compressor bleed air or a tangential on board injector.

In a further non-limiting embodiment of any of the foregoing methods, the fluid flowing across the outer surface flows through a passageway, the passageway including the outer surface, and the fluid enters the passageway through a notch in at least one of the disk and the cover plate.

In a further non-limiting embodiment of any of the foregoing methods, the fluid cools the outer surface of the disk.

In a further non-limiting embodiment of any of the foregoing methods, fluid is communicated from the fluid source through the first cavity and to an internal cooling passage within a blade airfoil attached to the disk.

A disk for a gas turbine engine according to an exemplary aspect of the disclosure includes, among other things a rotor having an outer perimeter, spaced apart slots extending axially about an axis to forward and aft faces, and each slot configured to receive a blade root, the outer perimeter providing an outer surface between the slots and including a notch, the notch adjacent to at least one of the forward and aft faces.

In a further non-limiting embodiment of the foregoing disk, the notch adjoins the forward face, further including a cover plate attached to the forward face of the disk, the cover plate providing a cavity in communication with the notch.

The embodiments, examples and alternatives of the preceding paragraphs, the claims, or the following descriptions and drawings, including any of their various aspects or respective individual features, may be taken independently or in any combination. Features described in connection with one embodiment are applicable to all embodiments, unless such features are incompatible.

The various features and advantages of this disclosure will become apparent to those skilled in the art from the following detailed description. The drawings that accompany the detailed description can be briefly described as follows.

DETAILED DESCRIPTION

Figure 1:
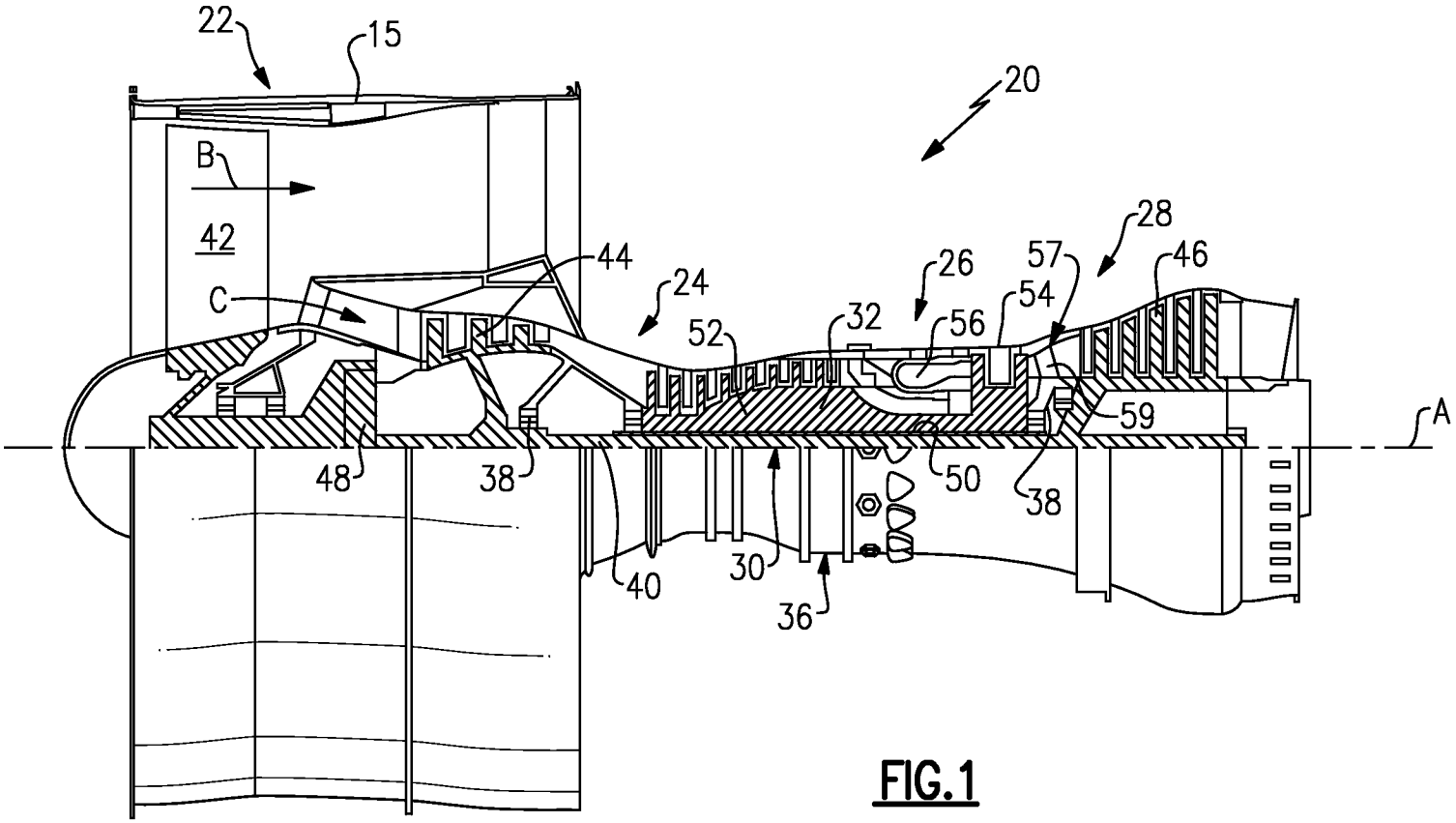
FIG. 1 is a schematic view of an example gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flow path B in a bypass duct defined within a nacelle 15, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 31 may be varied as appropriate to the application.

The low speed spool 30 generally includes an inner shaft 40 that interconnects a fan 42, a low pressure compressor 44 and a low pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged in exemplary gas turbine 20 between the high pressure compressor 52 and the high pressure turbine 54. A mid-turbine frame 57 of the engine static structure 36 is arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compress section 24, combustor section 26, turbine section 28, and fan drive gear system 50 may be varied. For example, gear system 50 may be located aft of combustor section 26 or even aft of turbine section 28, and fan section 22 may be positioned forward or aft of the location of gear system 48.

Figure 2:
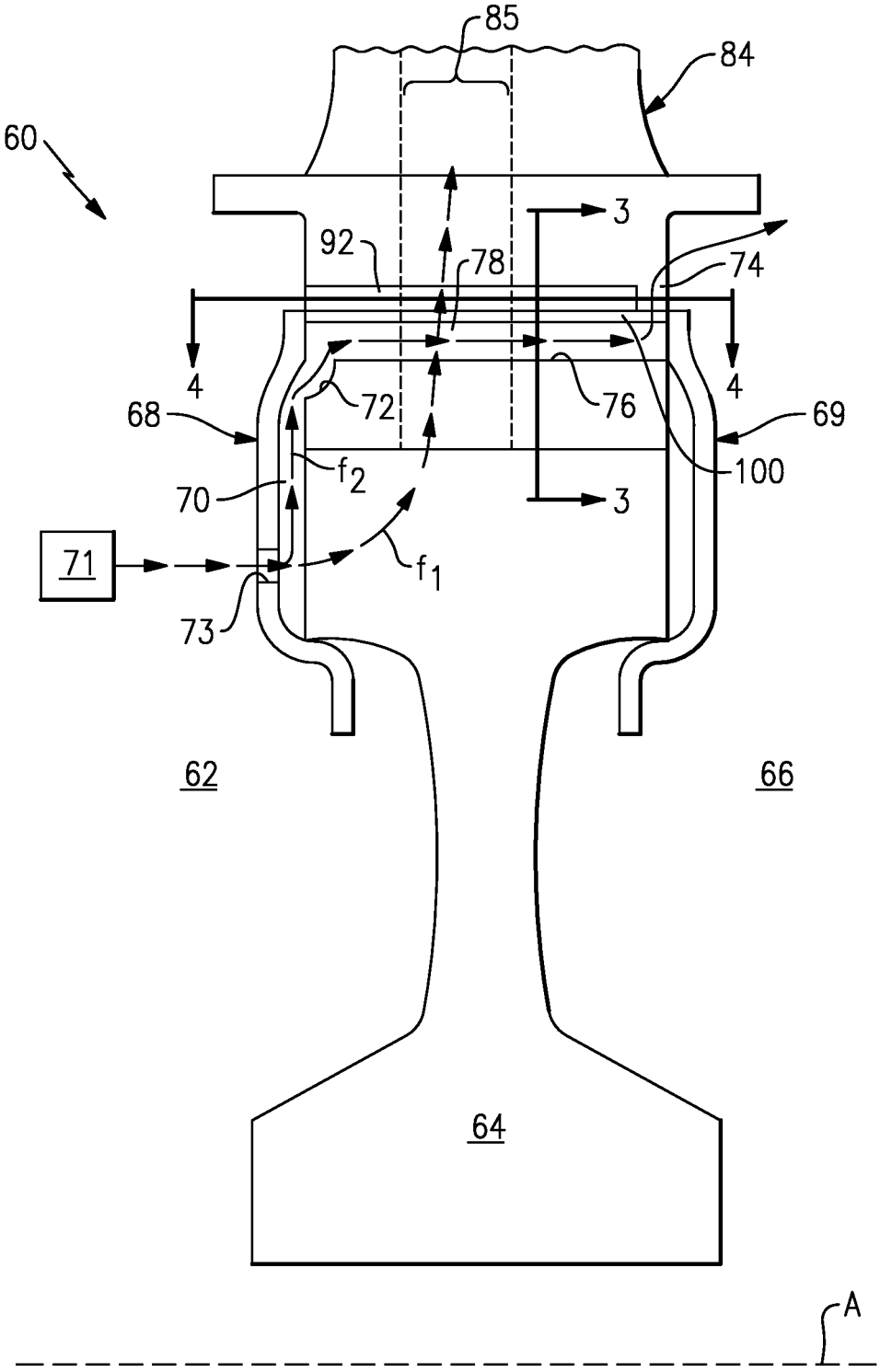
FIG. 2 is a schematic view of an example disk assembly.
Figure 3:
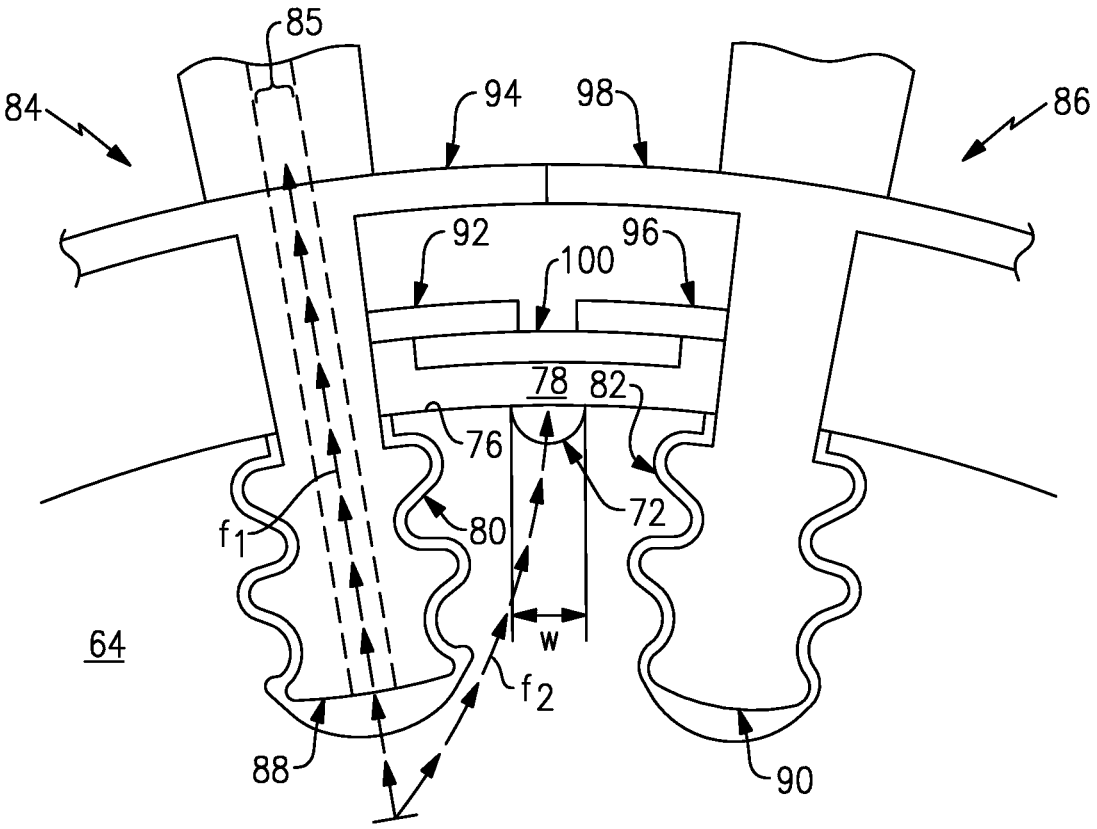
FIG. 3 is a sectional view of an example disk assembly, wherein the cut line is shown in FIG. 2.

Referring to FIGS. 2 and 3, with continued reference to FIG. 1, an assembly 60 is disclosed for providing fluid flow to a rotating section of gas turbine engine 20, for example a turbine stage or a compressor stage. A disk 64 is disclosed having a first axial side 62 and an axially opposite second axial side 66. The disk 64 rotates about axis A, shown schematically in FIG. 2.

A cover plate or minidisk 68 is adjacent to the first axial side 62 of the disk 64, providing a cavity 70. A second cover plate or minidisk 69 is provided at the second axial side 66. Fluid is provided from a fluid source 71 through a cover plate inlet 73 in the cover plate 68 and then flows to the blade 84, shown schematically as flow f1 in FIGS. 2 and 3. As shown, flow f1 flows to an internal cooling passage 85 within the blade airfoil.

In the example disk assembly 60, fluid flow is provided from the cavity 70 at the first axial side 62 of the disk 64 to the second axial side 66 of the disk 64 through a passageway 78, shown schematically as flow f2 in FIGS. 2 and 3.

Referring to FIGS. 2 and 3, a notch 72 is provided in the disk 64 at the first axial side 62. The notch 72 provides an inlet to passageway 78 and is in fluid communication with the cavity 70. Alternatively, as appreciated, a notch could be provided in the cover plate 68. An exit 74 is provided at the second axial side 66. The exit 74 is in fluid communication with the inlet notch 72 via passageway 78. Thus, the assembly 60 is configured to provide fluid flow from a cavity 70 at the first axial side 62, through inlet 72 and passageway 78, and to the exit 74 at the second axial side 66, as is illustrated schematically as flow f2 in FIG. 2. In the example, the first axial side 62 is forward and the second axial side 66 is aft. Alternatively, the first axial side 62 could be aft and the second axial side 66 could be forward.

In the example assembly 60, the passageway 78 is an area radially outward of the upper surface 76 of the disk 64. That is, the upper surface 76 of the disk 64 forms the radially inner boundary of the passageway 78. Thus, the assembly 60 is configured to provide fluid flow f2 across the upper surface 76 of the disk 64. Fluid flow f2 can thus be utilized to cool upper surface 76 of the disk 64. As appreciated, fluid flow f2 can cool other features in passageway 78.

Referring to FIG. 3, the upper surface 76 extends circumferentially between a first blade slot 80 in the disk 64 and a second blade slot 82 in the disk 64. The first blade slot 80 is configured to receive a first blade 84 at blade root 88. The second blade slot 82 is configured to receive a second blade 86 at blade root 90. The second blade 86 is circumferentially adjacent to the first blade 84. The notch 72 has a circumferential width w. The width w may extend up to the entire circumferential length of the upper surface 76.

Further referring to FIG. 3, the first blade 84 further comprises a blade shelf 92. The blade shelf 92 extends circumferentially from an upper portion of the blade root 88. The first blade shelf 92 is radially outward of the upper surface 76 of the disk 64 and radially inward of the blade platform 94. As shown schematically in FIG. 4, the blade shelf 92 extends axially from the first axial side 62 to the second axial side 66.

Similarly, the second blade 86 includes a second blade shelf 96. The second blade shelf 96 extends circumferentially from an upper portion of the blade root 90. The second blade shelf 96, the first blade shelf 92, and the upper surface 76 provide the passageway 78. The second blade shelf 96 is radially outward of the upper surface 76 of the disk 64 and radially inward of the platform 98 of the second blade 86. As shown schematically in FIG. 4, the second blade shelf 96 extends axially from the first axial side 62 to the second axial side 66.

The example assembly 60 further includes a rimseal 100 radially inward of and abutting the first blade shelf 92 and the second blade shelf 96. As shown schematically in FIG. 4A, the blade shelf 92, the blade shelf 96 and the rimseal 100 are be configured to create openings 102 and 104. In the FIG. 4A example, the blade shelves 92, 96 are contoured to provide the openings 102, 104. The openings 102, 104 provide the exit 74 located near the second axial side 66 and opposite the first axial side 62 where the notch 72 is located. As appreciated, the exit 74 is not limited to one embodiment and a fluid exit could be provided in other ways. As shown in the alternative FIG. 4B example, fluid could exit through recesses 106 in one or more of the rimseal 100, first blade shelf 92, and second blade shelf 96.

Figure 4A:
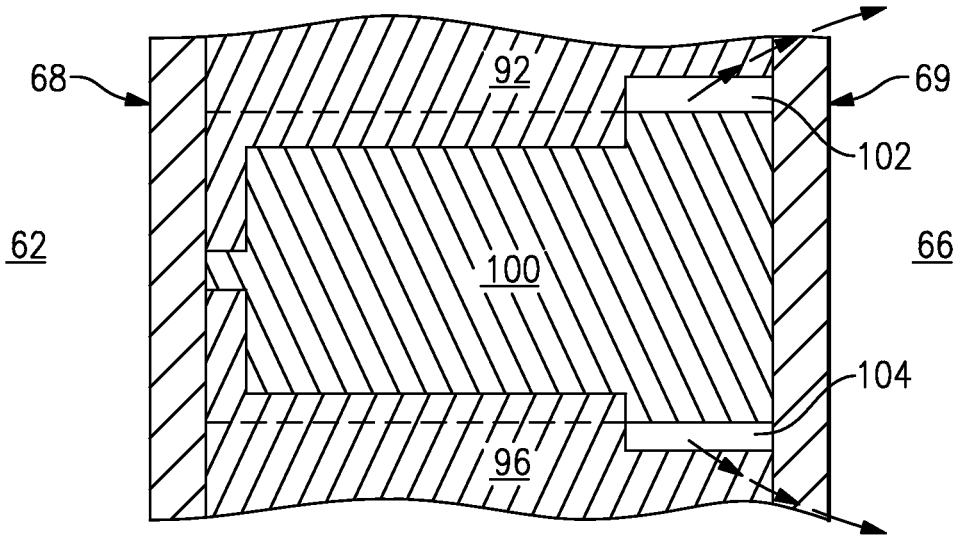
FIG. 4A is a sectional view of an example disk assembly, wherein the cut line is shown in FIG. 2.
Figure 4B:
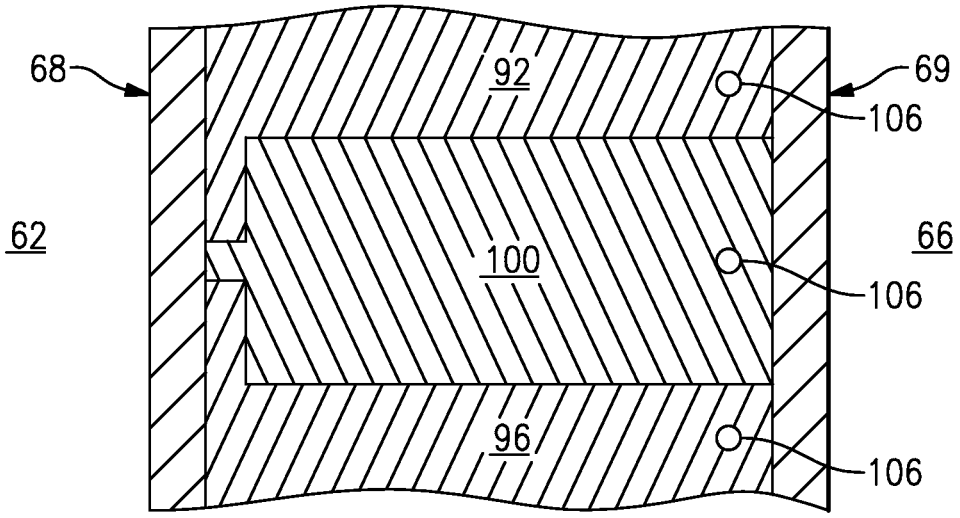
FIG. 4B shows an alternative fluid exit embodiment to that shown in FIG. 4A.

As shown in FIGS. 4A and 4B, the blade shelves 92, 96 and the rimseal 100 abut the first cover plate 68 and the second cover plate 69.

The example assembly 60 includes a fluid source 71, as shown schematically in FIG. 2. As one example, the fluid source 71 is compressor bleed air. As another example, the fluid source 71 is a tangential on board injector.

Figure 5:
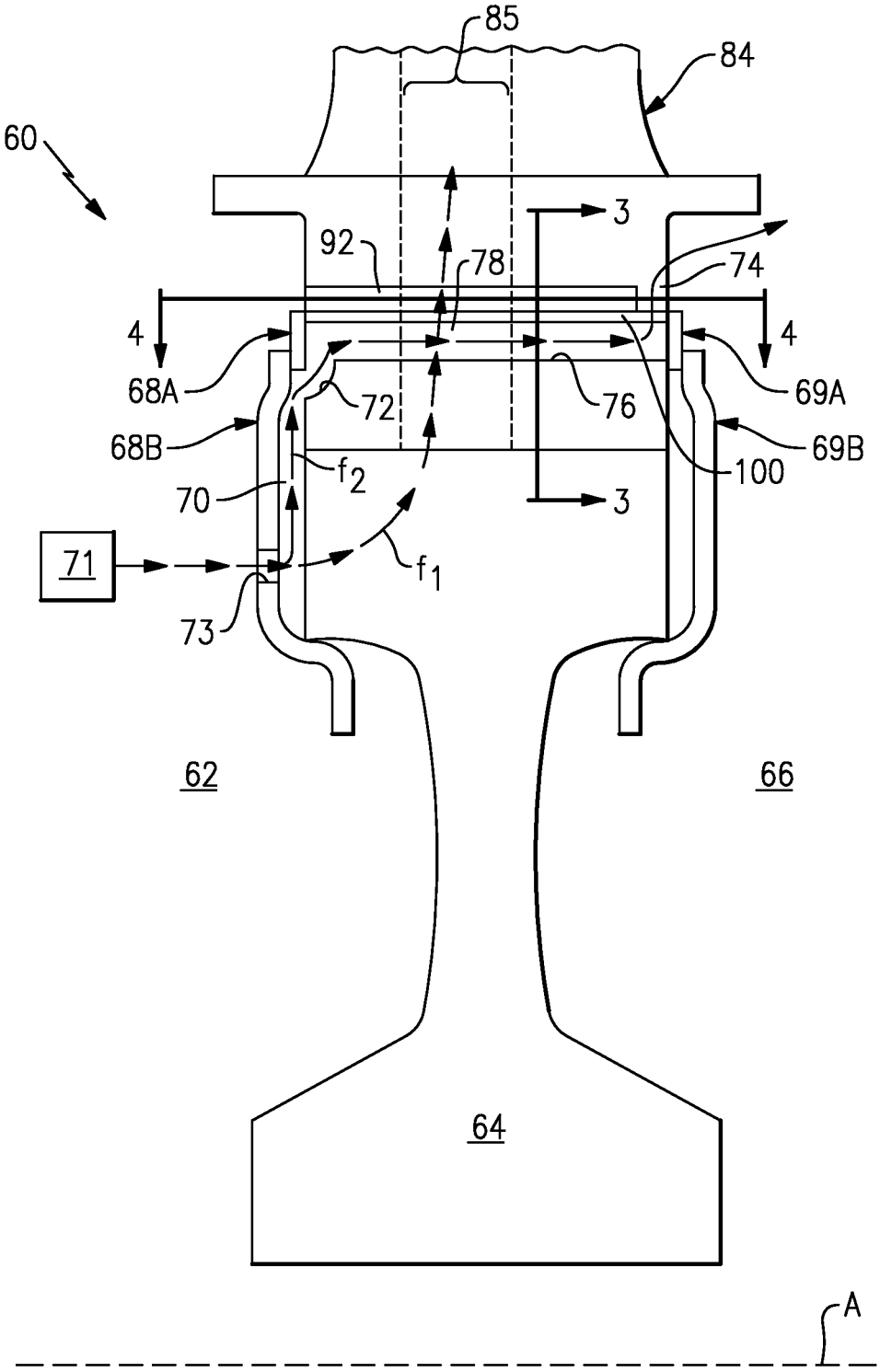
FIG. 5 is a schematic view of an example disk assembly having segmented cover plates.

As shown in FIG. 2, the first cover plate 68 and the second cover plate 69 are each one piece cover plates. Alternatively, as shown in FIG. 5, one or both of the first cover plate 68 and the second cover plate 69 could be segmented cover plates 68A, 68B and 69A, 69B, respectively.

Also disclosed is a method for providing a fluid flow to a rotating section of a gas turbine engine, for example a turbine stage. The method comprises communicating a fluid from a fluid source 71 to cavity 70 at first axial side 62. The method further comprises allowing the fluid to pass across the upper surface 76 of the disk 64 and exit through an exit 74 at the second axial side 66 opposite first axial side 62.

Referring to FIG. 2, the cavity 70 is provided by a cover plate 68 adjacent disk 64 at a first axial side 62. The fluid flowing across the outer surface 76 flows through a passageway 78. The passageway 78 includes the outer surface 76, and the fluid enters the passageway 78 through a notch 72 in at least one of the disk 64 or the cover plate 68.

As one example, the fluid source 71 for the method is compressor bleed air. As another example, the fluid source 71 is a tangential on board injector.

The method further comprises providing fluid from the fluid source 71 to the blade 84. Specifically, fluid is provided through the cavity 70 and to an internal cooling passage 85 within a blade airfoil. That is, the same cavity 70 is in fluid communication with both the passageway 78 and the blade 84.

The upper surface of the disk extends axially from the first axial side 62 to the second axial side 66. The first axial side 62 is axially opposite the second axial side 66. Referring to FIG. 3, the upper surface 76 extends circumferentially between blade slots 80, 82 in the disk.

Providing fluid to the upper surface 76 cools the upper surface 76. Cooling the upper surface 76 will reduce the temperature of the disk. By reducing the temperature of the disk, the size of the disk may be reduced, as material properties improve with reduced temperature. Cooling the disk can also enable use of less exotic materials for the disk for potential cost and weight reductions. Providing cooling to the disk can also allow for higher source temperatures, which could allow for an engine cycle that could provide improved engine performance.

Although an example embodiment has been disclosed, one of ordinary skill in this art would recognize that certain modifications would come within the scope of this disclosure. For that reason, the following claims should be studied to determine the scope and content of this disclosure.

What is claimed is:

1. An assembly comprising:

a disk;

a cover plate providing a cavity at a first axial side of the disk, a passageway including an inlet provided by a notch in at least one of the disk and the cover plate in fluid communication with the cavity, and the passageway extending from the inlet to an exit provided at a second axial side of the disk opposite the first axial side, the passageway is provided by an upper surface of the disk, the exit in fluid communication with the inlet, and the passageway configured to provide fluid flow from the cavity to the exit;

a first blade slot in the disk receiving a first blade, the first blade including a first blade shelf providing the passageway;

a second blade slot in the disk receiving a second blade, the second blade including a second blade shelf providing the passageway, wherein the upper surface extends circumferentially between the first and second blade slots, wherein the exit is provided by an opening in at least one of the first and second blade shelves; and a rimseal adjacent and radially inward of the first and second blade shelves.

2. The assembly of claim 1, wherein the first blade includes a first blade platform, the first blade shelf is radially inward of the first blade platform.

3. The assembly of claim 1, wherein a second exit is provided by an opening in the rimseal.

4. The assembly of claim 1, further comprising a fluid source, the fluid source configured to provide fluid to the cavity.

5. The assembly of claim 1, further comprising a fluid source, the fluid source configured to provide fluid through the cavity, into the inlet and out of the exit, wherein the fluid source also provides fluid through the cavity and to the first blade.

6. The assembly of claim 1, wherein the cavity is configured to separately provide fluid flow from the cavity to at least one of the first and second blades.

7. The assembly as recited in claim 1, comprising a tangential on board injector configured to provide fluid flow to the cavity.

8. The assembly as recited in claim 1, wherein the cover plate is a one-piece cover plate.

* * * * *